US007602290B2

(12) United States Patent
Jung

(10) Patent No.: US 7,602,290 B2
(45) Date of Patent: Oct. 13, 2009

(54) METHOD OF PROVIDING ELECTRONIC DEVICE INFORMATION TO MOBILE STATION AND SYSTEM USING THE SAME

(75) Inventor: Sung-Kwon Jung, Seoul (KR)

(73) Assignee: Samsung Electronics Co., Ltd (KR)

( * ) Notice: Subject to any disclaimer, the term of this patent is extended or adjusted under 35 U.S.C. 154(b) by 291 days.

(21) Appl. No.: 11/346,510

(22) Filed: Feb. 2, 2006

(65) Prior Publication Data

US 2006/0197667 A1 Sep. 7, 2006

(30) Foreign Application Priority Data

Feb. 23, 2005 (KR) ..... 10-2005-0015129

(51) Int. Cl.
*G08B 13/14* (2006.01)

(52) U.S. Cl. ..... 340/572.1; 340/539.24; 235/376

(58) Field of Classification Search ..... 340/572.1, 340/635, 539.24; 235/385, 375, 376; 702/58; 455/550.1, 423, 412.1
See application file for complete search history.

(56) References Cited

U.S. PATENT DOCUMENTS

| | | | | |
|---|---|---|---|---|
| 7,161,489 | B2 * | 1/2007 | Sullivan et al. | 340/572.4 |
| 7,181,501 | B2 * | 2/2007 | Defosse | 709/217 |
| 7,230,520 | B2 * | 6/2007 | Zaretsky et al. | 340/10.1 |
| 7,274,909 | B2 * | 9/2007 | Perttila et al. | 455/41.2 |
| 2006/0089168 | A1 * | 4/2006 | Ueda | 455/550.1 |
| 2006/0091207 | A1 * | 5/2006 | Chang | 235/385 |

* cited by examiner

*Primary Examiner*—Toan N Pham
(74) *Attorney, Agent, or Firm*—The Farrell Law Firm, LLP

(57) ABSTRACT

A system for providing electronic device information includes an electronic device, which includes a radio frequency identification (RFID) tag, for checking a state of the electronic device and storing electronic device state information and associated information in the RFID tag; and a mobile station, which includes an RFID reader for reading the RFID tag within a communicable range, for reading and displaying the electronic device state information and associated information stored in the RFID tag when the mobile terminal approaches the RFID tag of the electronic device.

13 Claims, 4 Drawing Sheets

METHOD OF PROVIDING ELECTRONIC DEVICE INFORMATION TO MOBILE STATION AND SYSTEM USING THE SAME

PRIORITY

This application claims priority under 35 U.S.C. § 119 to an application entitled "Method of Providing Electronic Device Information to Mobile Station and System Using the Same" filed in the Korean Intellectual Property Office on Feb. 23, 2005 and assigned Ser. No. 2005-15129, the contents of which are incorporated herein by reference.

BACKGROUND OF THE INVENTION

1. Field of the Invention

The present invention relates generally to a method of providing electronic device information using a mobile station including a radio frequency identification (RFID) reader and a system using the same.

2. Description of the Related Art

Radio frequency identification (RFID) technology is a type of contactless identification technology for transmitting and processing information on an object and its surrounding environment using radio frequency by attaching an ultra small sized chip to the object. In general, an RFID system includes an RFID tag, an antenna, and a reader. The RFID tag includes a predetermined memory for storing information and communicates with the reader wirelessly using a certain frequency. When the reader senses the RFID tag within a communicable distance, the reader automatically reads the information stored in the RFID tag and transmits the read information to a network. The RFID tag has various sizes and shapes, from several mm to a credit card size, and is generally classified as a passive tag and an active tag. While the active tag is implemented using an internal battery, the passive tag receives power from the reader reading it.

The biggest advantages of RFID products are that they use a contactless and non-line-of-sight method and that their implementation is not difficult. The only limited condition is a transmission distance, which is determined by power supplied to a system and a tag operational frequency. Such an RFID system is used in industries in which trace and management is necessary, logistics/delivery and transportation cards are a representative utilization of the RFID system, and the use of the RFID system is becoming popular. The RFID technology has been applied to various fields. In particular, the RFID technology can be efficiently used to provide information on an object to which an RF tag is attached.

SUMMARY OF THE INVENTION

Accordingly, the present invention provides a method of providing electronic device information using a mobile station including a radio frequency identification (RFID) reader and a system using the same.

According to one aspect of the present invention, there is provided a system for providing electronic device information, the system including an electronic device, which includes a radio frequency identification (RFID) tag, for checking a state of the electronic device and storing electronic device state information and associated information in the RFID tag; and a mobile station, which includes an RFID reader for reading the RFID tag within a communicable range, for reading and displaying the electronic device state information and associated information stored in the RFID tag when the mobile terminal approaches the RFID tag of the electronic device.

According to another aspect of the present invention, there is provided a method of providing electronic device information in a system including a radio frequency identification (RFID) tag equipped electronic device and an RFID reader equipped mobile station, the method including checking, by the electronic device, a state of the electronic device and storing electronic device state information and associated information in the RFID tag; and reading and displaying, by the mobile station, the electronic device state information and associated information stored in the RFID tag when the mobile station approaches the RFID tag of the electronic device.

BRIEF DESCRIPTION OF THE DRAWINGS

The above and other objects, features and advantages of the present invention will become more apparent from the following detailed description when taken in conjunction with the accompanying drawings in which.

DETAILED DESCRIPTION OF THE PREFERRED EMBODIMENT

Figure 1:
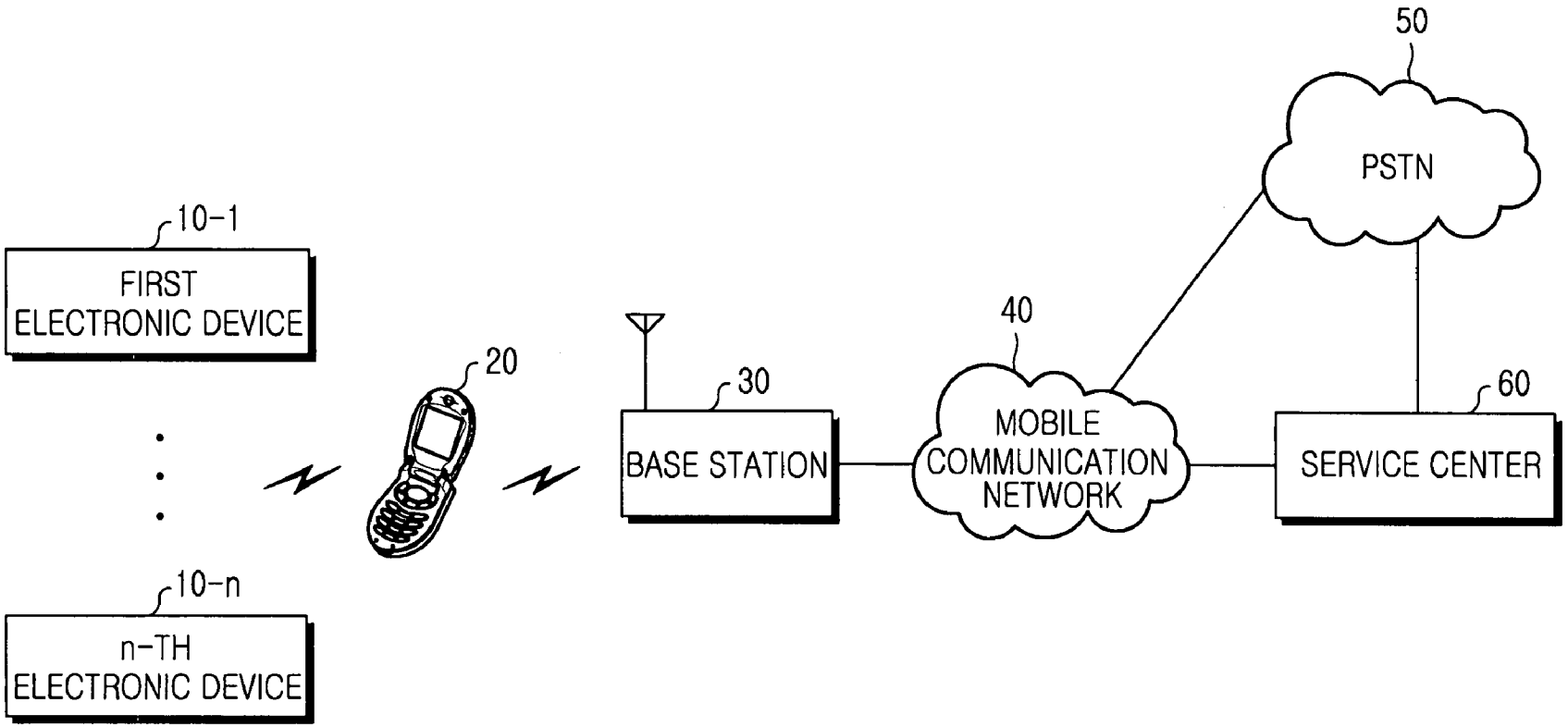
FIG. 1 is a schematic diagram of a system including RFID tag equipped electronic devices and an RFID reader equipped mobile station according to a preferred embodiment of the present invention.

Preferred embodiments of the present invention will be described herein below with reference to the accompanying drawings. In the drawings, the same or similar elements are denoted by the same reference numerals even though they are depicted in different drawings. In the following description, well-known functions or constructions are not described in detail since they would obscure the invention in unnecessary detail.

According to an embodiment of the present invention, an electronic device stores its own state information in a radio frequency identification (RFID) tag, and an RFID reader equipped mobile station reads data stored in the RFID tag of the electronic device and displays the read data to a user. When a user makes a phone call in a state where the mobile station displays the data read from the RFID tag of the electronic device, the mobile station transmits a call to a telephone number included in the displayed data.

According to an embodiment of the present invention, a user can know a state of an RFID tag equipped electronic device without looking up a manual of the electronic device by approaching the electronic device with an RFID reader equipped mobile station. Thus, the user can control the electronic device according to the state of the electronic device. In addition, the user can easily connect a call to a service branch providing after service (AS) for the electronic device.

A system including RFID tag equipped electronic devices and an RFID reader equipped mobile station will now be described with reference to FIG. 1. FIG. 1 is a schematic diagram of an electronic device information providing system according to a preferred embodiment of the present invention. The electronic device information providing system includes one or more RFID tag equipped electronic devices 10-1, . . . , 10-n and an RFID reader equipped mobile station 20. The electronic devices 10-1, . . . , 10-n and the mobile station 20 can communicate with each other through RFID technology.

The electronic device information providing system also includes a base station 30, a mobile communication network 40, a Public Switched Telephone Network (PSTN) 50, and a service center 60. The base station 30 communicates with the mobile station 20 using a wireless channel. The mobile station 20 can connect a call to the service center 60 via the mobile communication network 40. The mobile station 20 also can connect a call to the PSTN 50 via the mobile communication network 40 and then to the service center 60. The service center 60 provides AS for the electronic devices 10-1, . . . , 10-n.

In detail, each of the electronic devices 10-1, . . . , 10-n can determine a state, malfunction, or error by itself. The electronic devices 10-1, . . . , 10-n, in general, include general home appliances, e.g., a refrigerator, a TV set, and an audio set, and the present invention is not limited to them. Each of the electronic devices 10-1, . . . , 10-n stores its state information and associated information in an RFID tag. When detecting a malfunction or an error, each of the electronic devices 10-1, . . . , 10-n also stores malfunction or error information and associated information in the RFID tag. Herein, each of the electronic devices 10-1, . . . , 10-n can store information on an AS center of a corresponding electronic device in the RFID tag.

When the mobile station 20 approaches an electronic device 10-1, . . . , 10-n, the RFID reader equipped in the mobile station 20 detects an RFID tag equipped in the electronic device 10-1, . . . , 10-n and reads data stored in the RFID tag. Then, the mobile station 20 analyzes the RFID data and displays the analyzed data to a user. With this, the user can know a state or malfunction of the electronic device 10-1, . . . , 10-n and control the electronic device 10-1, . . . , 10-n based on the state or malfunction information.

The user also can know a telephone number of an AS center of the electronic device 10-1, . . . , 10-n. When the user wants to call the AS center of the electronic device 10-1, . . . , 10-n after seeing the state or malfunction information displayed on the mobile station 20, the user can make a phone call to the AS center by just pushing a "send" key without searching for the telephone number of the AS center. Configurations and operations of an electronic device 10 and the mobile station 20 will now be described.

Figure 2:
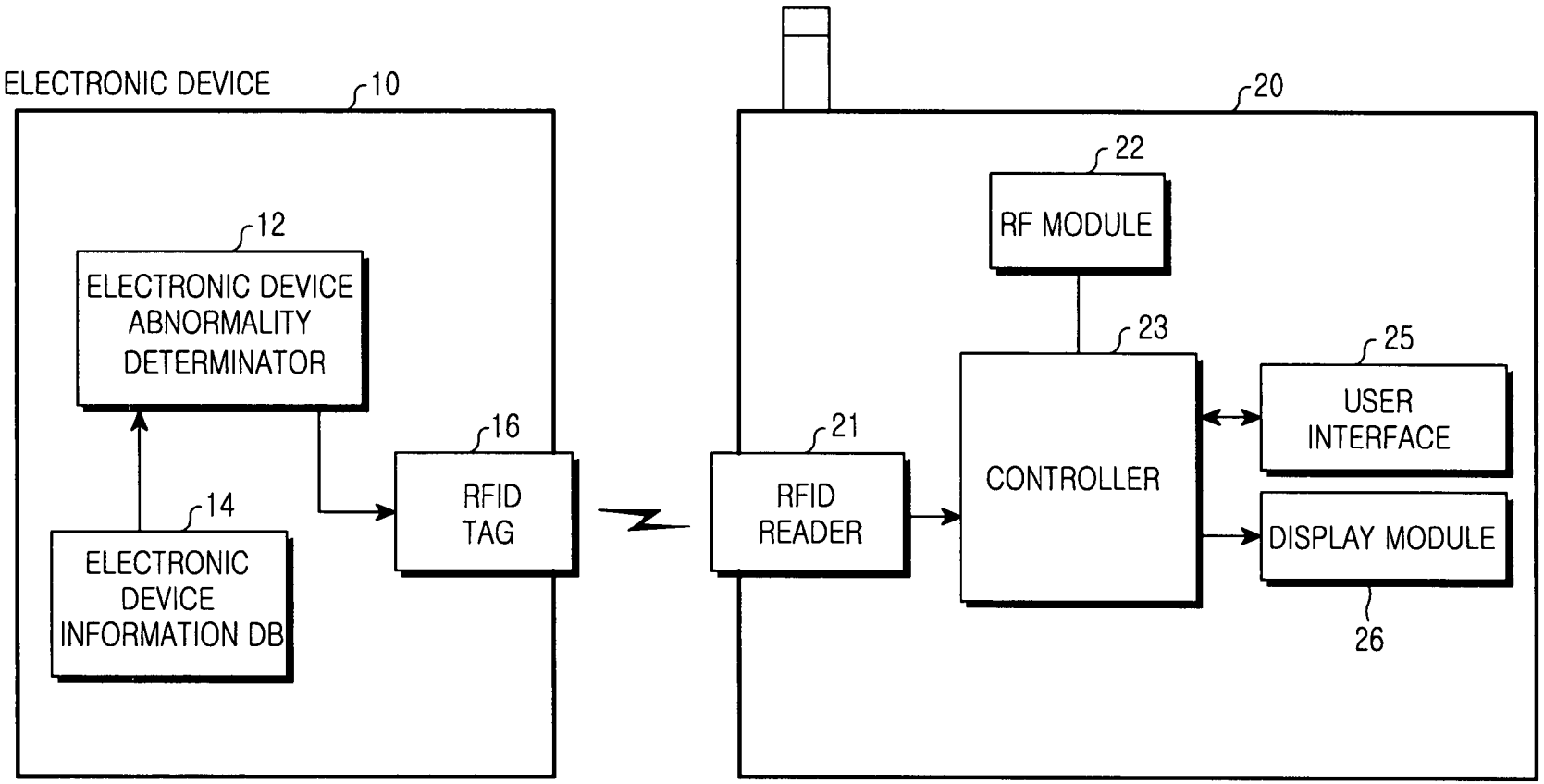
FIG. 2 is a block diagram of an electronic device and a mobile station according to a preferred embodiment of the present invention.

FIG. 2 is a block diagram of the electronic device 10 and the mobile station 20 according to a preferred embodiment of the present invention. Referring to FIG. 2, the electronic device 10 includes an electronic device abnormality determinator 12, an electronic device information database 14, and an RFID tag 16. The electronic device abnormality determinator 12 can determine a state, malfunction, or error of the electronic device 10.

In detail, the electronic device abnormality determinator 12 checks a current state of the electronic device 10 and stores the current state information in the RFID tag 16. Herein, the electronic device abnormality determinator 12 can read current electronic device state information and associated information from the electronic device information database 14. For example, the electronic device 10 can store information set for an operation of the electronic device 10 in the RFID tag 16 as state information. The electronic device 10 also can store information regarding a controllable function or a control method in the RFID tag 16 according to current operational set information.

The electronic device information database 14 stores electronic device state information and associated information. For example, the electronic device information database 14 typically stores self-diagnosis information such as contents included in a manual of the electronic device 10.

According to another embodiment of the present invention, the electronic device abnormality determinator 12 checks a state of the electronic device 10, and if a function or setting different from a general operational state is detected, the electronic device abnormality determinator 12 can store the abnormal state information in the RFID tag 16. In this case, the electronic device abnormality determinator 12 can store in the RFID tag 16 information regarding a controllable function or a control method to return the function or setting different from the general operational state to the general operational state.

In addition, the electronic device abnormality determinator 12 can determine a malfunction or an error of the electronic device 10 and store malfunction or error information and associated information in the RFID tag 16. The information regarding the malfunction or error of the electronic device 10 can include information to solve the malfunction or error. Herein, the electronic device abnormality determinator 12 can store a malfunction occurrence time, a model name of the electronic device 10, an AS center telephone number, and a manufacturer telephone number in the RFID tag 16 with the information regarding the malfunction or error of the electronic device 10.

The mobile station 20 includes an RFID reader 21, an RF module 22, a controller 23, a user interface 25, and a display module 26. The RFID reader 21 reads data of the RFID tag 16 within an RFID communicable range. In detail, when a user causes the RFID reader equipped mobile station 20 to approach the RFID tag equipped electronic device 10, the RFID reader 21 detects the RFID tag 16 equipped in the electronic device 10 and reads data stored in the RFID tag 16. The RFID reader 21 outputs the data read from the RFID tag 16 to the controller 23.

The controller 23 controls an operation of the mobile station 20 such as a telephone call or data transmission/reception. The controller 23 also analyzes the RFID data output from the RFID reader 21 and displays the analyzed result on the display module 26. When the user pushes a "send"0 key in a state of displaying electronic device state information or malfunction/error information on the display module 26, the controller 23 makes a phone call to a telephone number included in the RFID data.

The controller 23 controls the display module 26 to display various kinds of messages. The display module 26 can be constructed of a liquid crystal display (LCD), thin film transistor (TFT), or organic electroluminescence. The user interface 25 includes a plurality of number keys and function keys and outputs key-input data corresponding to a key pushed by the user to the controller 23. The RF module 22 transmits and receives RF signals to and from the base station 30 via an antenna.

Figure 3:
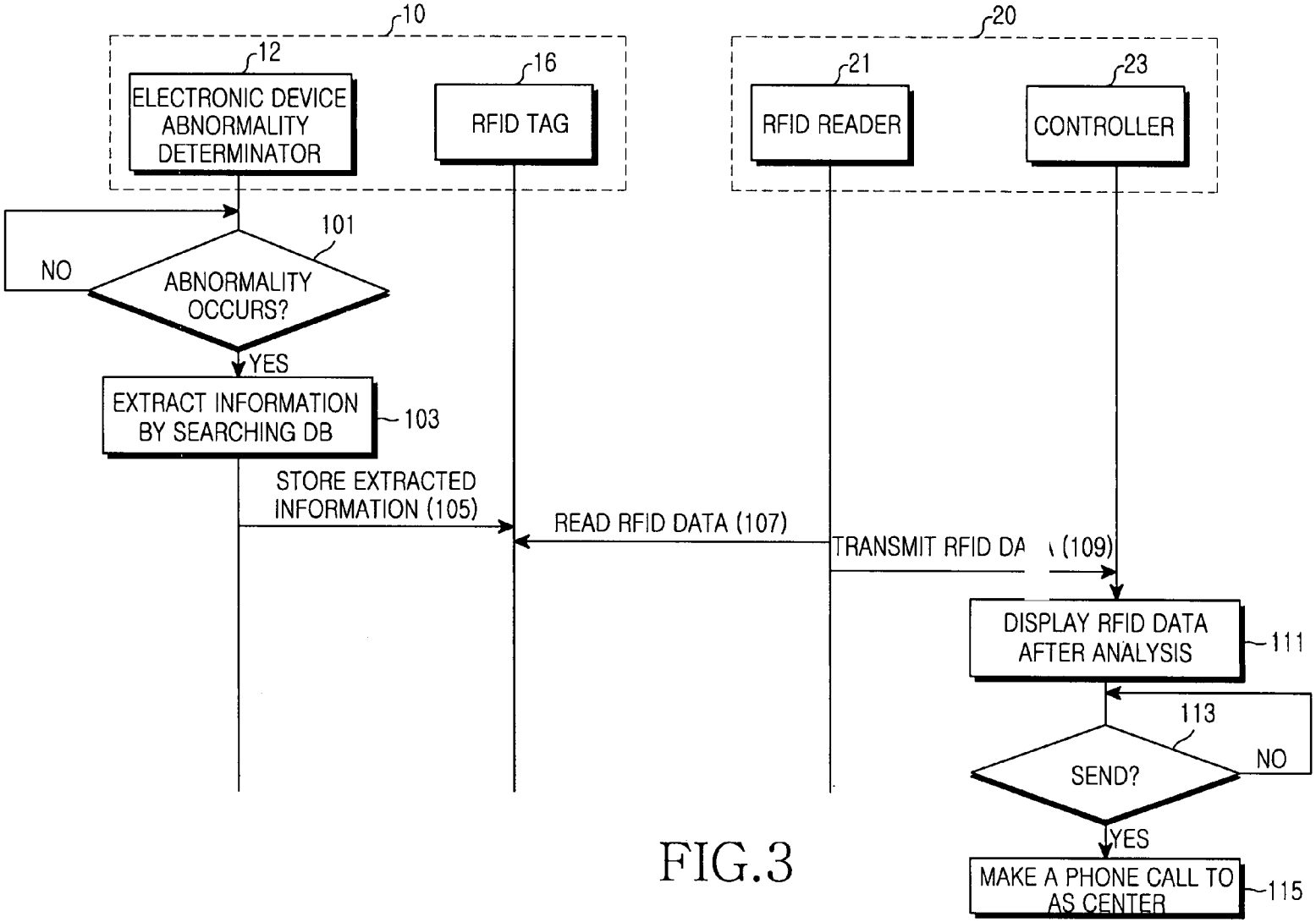
FIG. 3 is a signaling diagram illustrating an operation between an electronic device and a mobile station according to a preferred embodiment of the present invention.

FIG. 3 is a signaling diagram illustrating an operation between the electronic device 10 and the mobile station 20 according to a preferred embodiment of the present invention.

Referring to FIG. 3, in step 101 the electronic device abnormality determinator 12 of the electronic device 10 determines whether a malfunction or error, i.e., an abnormality, has occurred in the electronic device 10. If an abnormality has occurred in the electronic device 10, in step 103, the electronic device abnormality determinator 12 extracts information regarding corresponding abnormality information by searching the electronic device information database 14.

Herein the extracted information can be information to solve the abnormality, e.g., a malfunction or error, as described above. The extracted information also can be description for explaining the abnormality so that the user can know about the abnormality. In step 105, the electronic device abnormality determinator 12 stores the abnormality information and associated information in the RFID tag 16. Herein, the electronic device abnormality determinator 12 can store a malfunction occurrence time, a model name of the electronic device 10, an AS center telephone number, a manufacturer telephone number, etc. in the RFID tag 16.

According to another embodiment of the present invention, if a function or setting that is different from a general operational state is detected, the electronic device abnormality determinator 12 can store the abnormal state information in the RFID tag 16. In this case, the electronic device abnormality determinator 12 can store in the RFID tag 16 information regarding a controllable function or a control method to return the function or setting to the general operational state. The electronic device abnormality determinator 12 also checks current state information of the electronic device 10 and stores the current state information of the electronic device 10 in the RFID tag 16. This can be periodically performed or when the electronic device 10 is turned on. By doing this, the electronic device state information and associated information are stored in the RFID tag 16 of the electronic device 10.

Thereafter, the RFID reader 21 of the mobile station 20 reads data of the RFID tag 16 within an RFID communicable range. In detail, when the user causes the RFID reader equipped mobile station 20 to approach the RFID tag equipped electronic device 10, in step 107, the RFID reader 21 detects the RFID tag 16 equipped in the electronic device 10 and reads data stored in the RFID tag 16. In step 109, the RFID reader 21 outputs the data read from the RFID tag 16 to the controller 23.

Figure 4A:
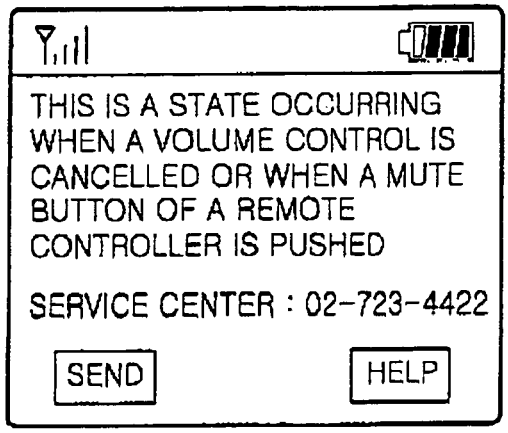
FIGS. 4A and 4B are illustrations of a screen of a mobile station on which electronic device information is displayed according to a preferred embodiment of the present invention.
Figure 4B:
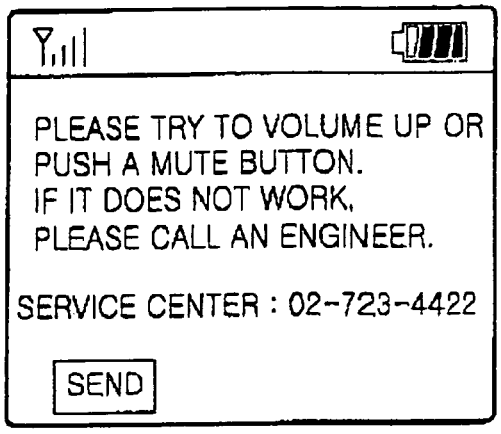

In step 111, the controller 23 analyzes the RFID data and displays the analyzed result on the display module 26. Illustrations of a screen of the display module 26 are shown in FIGS. 4A and 4B. FIG. 4A is an image displayed when an electronic device, such as a TV, is in an abnormal state or setting which is different from a general operational state. For example, in general, the TV is set to output sound in a predetermined volume level for watching. Therefore, if the sound volume level is set to zero or set to not output sound due to a pushed mute button, it is out of the general operational state. As described above, if an abnormal state or setting occurs, the electronic device 10 stores the state in the RFID tag 16 and selectively stores its associated information in the RFID tag 16. In addition, a telephone number of an AS center of the electronic device 10 can be stored in the RFID tag 16.

In FIGS. 4A and 4B, if the TV is set to not output sound in a predetermined volume level, the TV stores in its RFID tag the abnormal state information and information regarding a controllable function or a control method to return the TV to the general operational state. The current TV operational state is displayed on the screen of FIG. 4A, and the information regarding a control method to return the TV to the general operational state is displayed on the screen of FIG. 4B. A telephone number of an AS center of the TV is displayed on each screen of FIGS. 4A and 4B.

Referring back to FIG. 3, in step 113, the controller 23 determines whether the user pushes a "send" key in a state of displaying the electronic device information on the display module 26. The user may not be satisfied with the displayed electronic device information. That is, the user may not be able to solve a problem of the electronic device 10 using the displayed electronic device information. In this case, the user may want to make a phone call to an AS center of the electronic device 10. If the "send" key is pushed by the user in the state of displaying the electronic device information on the display module 26, in step 115, the controller 23 makes a phone call to the telephone number displayed on the display module 26. That is, if the user pushes the "send" key in the state of displaying the telephone number of the AS center of the electronic device 10 on the screen of the display module 26, the controller 23 makes a phone call to the telephone number of the AS center.

As described above, according to the present invention, an electronic device stores its state information in an RFID tag, and an RFID reader equipped mobile station reads data stored in the RFID tag of the electronic device and displays the read data to a user. In addition, if the user pushes a "send" key in a state of displaying the data read from the RFID tag of the electronic device, the mobile station makes a phone call to a telephone number included in the displayed data.

While the invention has been shown and described with reference to a certain preferred embodiment thereof, it will be understood by those skilled in the art that various changes in form and details may be made therein without departing from the spirit and scope of the invention. For example, while the above embodiments have been implemented using the RFID technology, the present invention can be implemented using all local area communication technology by which an electronic device and a mobile station can communicate with each other.

As described above, according to embodiments of the present invention, a user can know a state of an RFID tag equipped electronic device without looking up a manual of the electronic device merely by approaching the electronic device with an RFID reader equipped mobile station. Thus, the user can control the electronic device according to the state of the electronic device. In addition, the user can easily connect a call to a service branch providing AS for the electronic device.

What is claimed is:

1. A system for providing electronic device information, the system comprising:

an electronic device equipped with a radio frequency identification (RFID) tag, for periodically checking a state of the electronic device and, when a function or setting different from a general operational state in the electronic device is detected, storing electronic device state information and associated information in the RFID tag; and a mobile station equipped with an RFID reader for reading the RFID tag within a communicable range, for reading and displaying the electronic device state information and associated information stored in the RFID tag when the mobile terminal approaches the RFID tag of the electronic device.

2. The system of claim 1, wherein the associated information is information regarding a controllable function or a control method to return the function or setting to the general operational state.

3. The system of claim 1, wherein if a malfunction or error occurs in the electronic device, the electronic device stores the malfunction or error information of the electronic device and its associated information in the RFID tag.

4. The system of claim 3, wherein the associated information is information to solve the malfunction or error.

5. The system of claim 1, wherein the electronic device further comprises:

an electronic device abnormality determinator for checking a current state of the electronic device and storing electronic device state information and associated information in the RFID tag; and an electronic device information database for storing the electronic device state information and associated information.

6. The system of claim 1, wherein the electronic device associated information comprises a telephone number of an after service (AS) center of the electronic device.

7. The system of claim 6, wherein if a user pushes a "send" key in a state of displaying the telephone number, the mobile station makes a phone call to the displayed telephone number.

8. A method of providing electronic device information in a system including a radio frequency identification (RFID) tag equipped electronic device and an RFID reader equipped mobile station, the method comprising the steps of:

periodically checking, by the electronic device, a state of the electronic device and, when a function or setting different from a general operational state in the electronic device is detected, storing electronic device state information and associated information in the RFID tag; and reading and displaying, by the mobile station, the electronic device state information and associated information stored in the RFID tag when the mobile station approaches the RFID tag of the electronic device.

9. The method of claim 8, wherein the associated information is information regarding a controllable function or a control method to return the function or setting to the general operational state.

10. The method of claim 8, wherein in the step of storing, if a malfunction or error occurs in the electronic device, the malfunction or error information of the electronic device and its associated information are stored in the RFID tag.

11. The method of claim 10, wherein the associated information is information to solve the malfunction or error.

12. The method of claim 8, wherein the electronic device associated information comprises a telephone number of an after service (AS) center of the electronic device.

13. The system of claim 12, further comprising the step of:

if a user pushes a "send" key in a state of displaying the telephone number, making, by the mobile station, a phone call to the displayed telephone number.

* * * * *

UNITED STATES PATENT AND TRADEMARK OFFICE

CERTIFICATE OF CORRECTION

PATENT NO. : 7,602,290 B2
APPLICATION NO. : 11/346510
DATED : October 13, 2009
INVENTOR(S) : Sung-Kwon Jung It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 323 days.

Signed and Sealed this

Fifth Day of October, 2010

David J. Kappos

David J. Kappos
*Director of the United States Patent and Trademark Office*